US005086711A

United States Patent [19]

Matthews

[11] Patent Number: 5,086,711

[45] Date of Patent: Feb. 11, 1992

[54] COLLAPSIBLE TABLE

[76] Inventor: Ernest Matthews, 143A, Belmont Circular Road, Belmont, Trinidad and Tobago

[21] Appl. No.: 519,215

[22] Filed: May 7, 1990

[30] Foreign Application Priority Data

May 5, 1989 [TT] Trinidad and Tobago ..... 40/1989

[51] Int. Cl.[5] ..... A47B 3/02

[52] U.S. Cl. ..... 108/119; 292/153

[58] Field of Search ..... 108/119, 118, 120; 292/153

[56] References Cited

FOREIGN PATENT DOCUMENTS 0516859 2/1955 Italy ..... 108/118

0538847 11/1959 Italy ..... 108/119

0834450 5/1960 United Kingdom ..... 108/118

*Primary Examiner*—Kenneth J. Dorner

*Assistant Examiner*—Gerald A. Anderson

[57] ABSTRACT

The present invention provides for a collapsible table comprising a table top, and first and second legs having a scissors action connection to one another. The first leg is pivotally secured at a first location to the table top, and the second leg is pivotally and removably secured by releasable securing means at a second location to the table top spaced from the first location. Releasable locking means are provided for releasably securing the securing means. In a further aspect of the invention, the locking means is provided by a locking lever having a securing means receiving means for releasably securing the securing means in the operating position.

3 Claims, 2 Drawing Sheets

FIG. 4
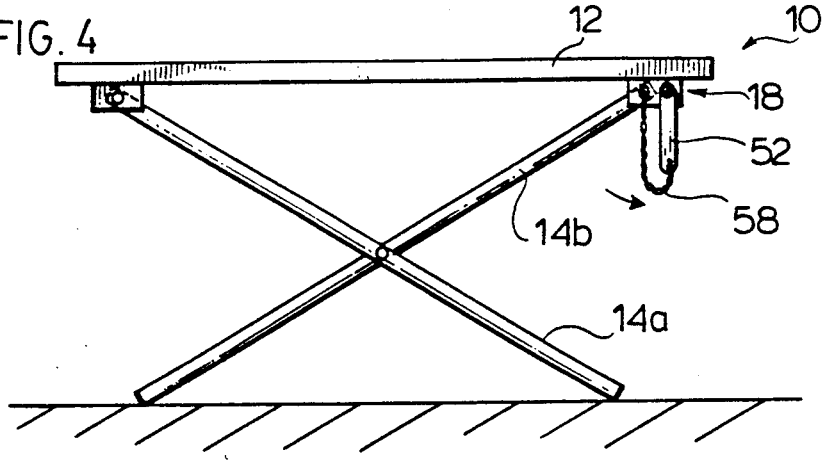
FIG. 5
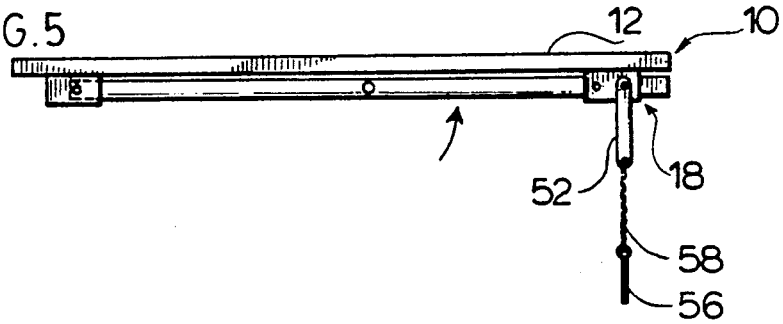
FIG. 7
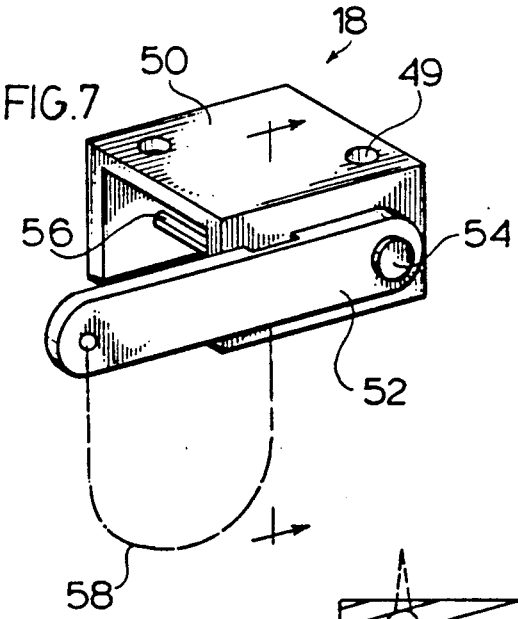
FIG. 6
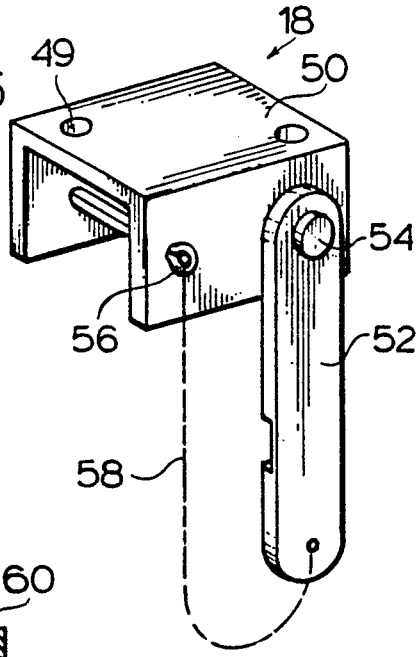
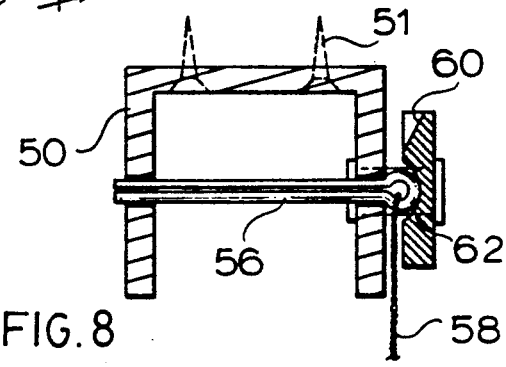
FIG. 8

COLLAPSIBLE TABLE

FIELD OF THE INVENTION

The present invention relates to collapsible tables that have a novel leg locking system to provide for securement of the legs during operation of the table while allowing easy collapse of the table for storage.

BACKGROUND OF THE INVENTION

At the present time, collapsible tables are generally constructed having legs hingedly attached to the under saurface of the table top at either end of the table. Extending between the under surface of the table top remote form the hinged attachment of the legs and the lower portion of the legs is a collapsible support arm which acts to brace the table leg when the table is in use and is collapsible to allow the legs to be drawn up into contact with the under surface for storage of the table. However, with extensive use, such support arms may become sloppy in their operation and the ability of the support arm to brace the table leg may be reduced, thereby increasing the risk of collapse of the table during use.

SUMMARY OF THE INVENTION

The present invention provides for a collapsible table comprising a table top, and first and second legs having a scissors action connection to one another. The first leg is pivotally secured at a first location to the table top, and the second leg is pivotally and removably secured by releasable securing means at a second location to the table top spaced from the first location. Releasable locking means are provided for releasably securing the securing means.

In an aspect of the invention, the locking means is provided by a locking lever having a securing means receiving means for releasably securing the securing means in the operating position.

BRIEF DESCRIPTION OF THE DRAWINGS

The above as well as other advantages and features of the present invention will be described in greater detail according to the preferred embodiments of the present invention in which:

FIG. 4 is a side elevation view of the table of FIG. 1, FIG. 5 is a side elevation view of the table of FIG. 1 in the collapsed position for storage, FIG. 6 is a perspective view of the attaching means of the table of the FIG. 1, FIG. 7 is a perspective view of the attaching means of FIG. 6 in a locked position, and FIG. 8 is a cross-section of the attaching means of FIG. 7.

DETAILED DESCRIPTION ACCORDING TO THE PREFERRED EMBODIMENTS OF THE PRESENT INVENTION

Figure 1:
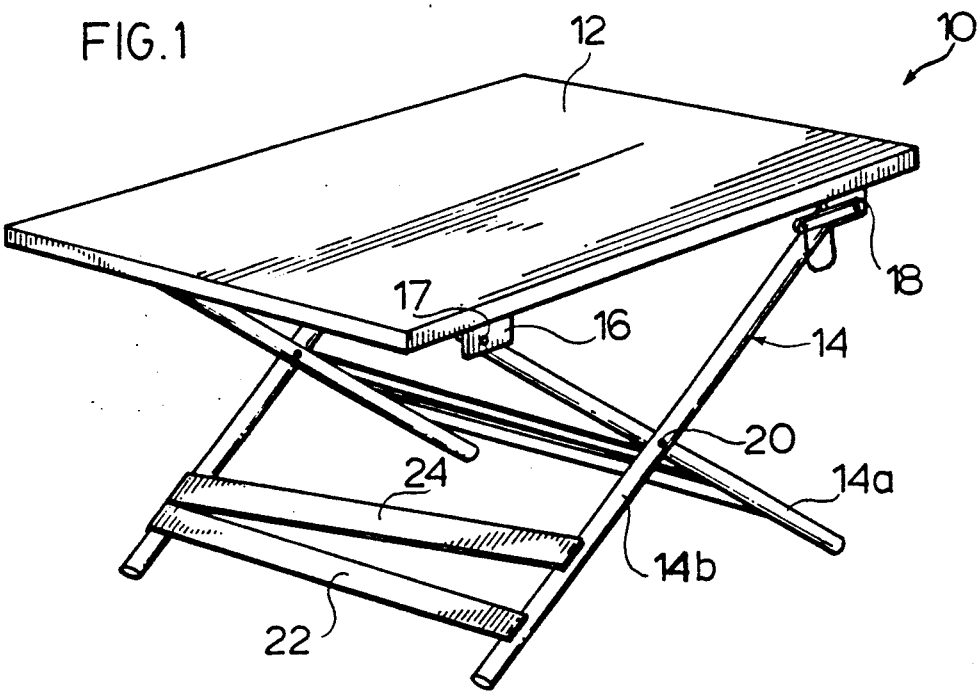
FIG. 1 is a perspective view of one embodiment of the collapsible table of the present invention.

One embodiment of a collapsible table constructed in accordance with the present invention is shown generally in FIG. 1 indicated by the numeral 10. The table comprises a table top 12 which can be of any or the common sizes and shapes depending upon the use for which the table is intended. For example the table top can be rectangular as shown in the figures or it can be round oval or square. Attached to the table top 12 at each end are pairs of legs 14. The first and second legs **14*a* and 14*b* of the pair of legs 14 are connected together in an X-shape by means of pivot pin 20 to provide legs having a scissors action connection to one another. One of the legs 14*a* is pivotally secured at a first location to the table top 12 by means of a bracket 16. The top of the leg 14*a* fits into the bracket and a bolt 17 is placed through holes provided in the bracket 16 and in the top of the leg 14*a* and thereafter secured with a suitable nut. In this way leg 14*a* is securely held in the bracket 16 while being free to pivot about the bolt 17**.

The other leg **14*b* is removably secured to the table top 12 at a second location spaced from the first location by means of an attaching means 18 to be described further herein below. Each of legs 14*a* and 14*b* is attached to its complementary member at the opposite end of the table through means of cross-bars 22 and 24. Preferably, to increase the stability of the table, one of the cross-bars 22 is provided extending horizontally between the complementary legs 14*a* or 14*b* while the second cross-bar 24 is provided extending at an angle relative to the horizontal bar 22**.

Figure 2:
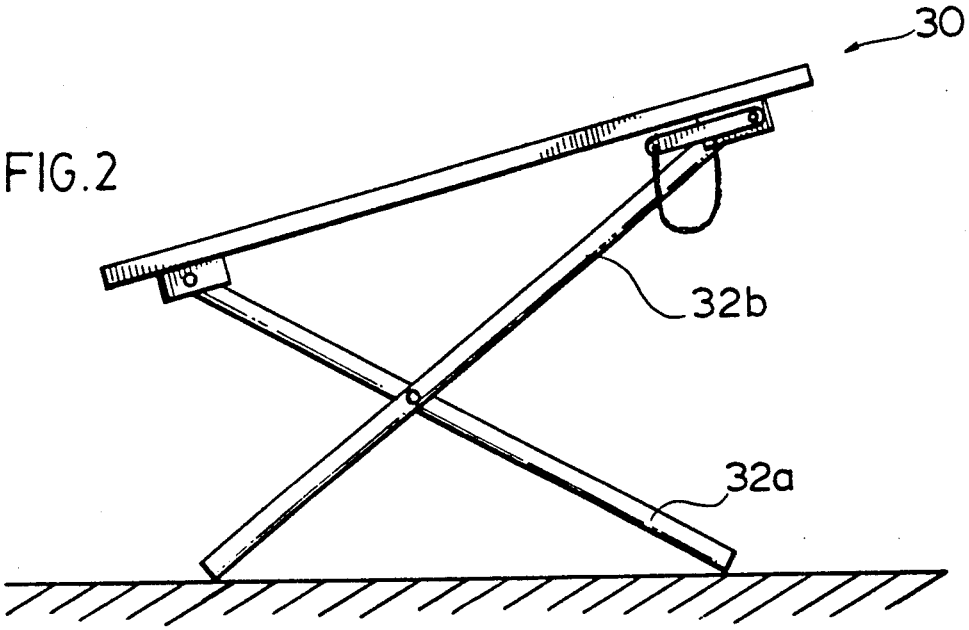
FIG. 2 is a side elevation view of a second embodiment of the collapsible table of the present invention.
Figure 3:
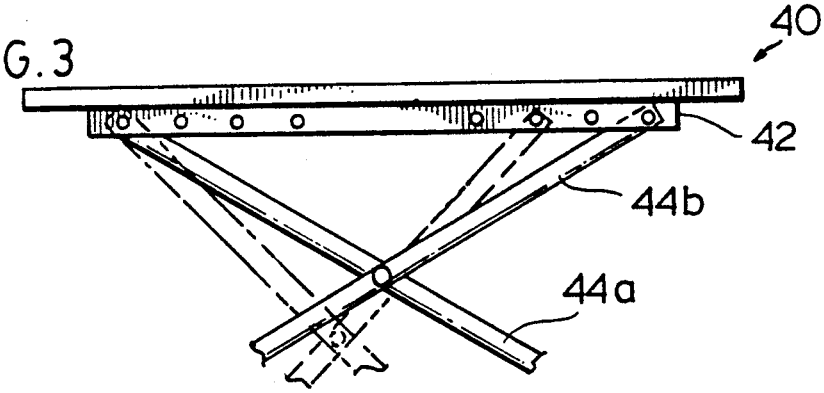
FIG. 3 is a side elevation view of a third embodiment of the collapsible table of the present invention.

A second embodiment of a collapsible table constructed in accordance with the present invention is shown in FIG. 2 indicated by the numeral 30. This table is provided with legs **32*a* and 32*b* of unequal length to provide for an angled table top for use for example as a drafting table. FIG. 3 illustrates yet another embodiment of the table indicated by numeral 40. This table provides for an adjustable height by the provision of an elongated attaching means 42 in place of bracket 16 and attaching means 18 of the first and second embodiments. Attaching means 42 is provided with numerous anchoring points to permit flexibility in the point of anchoring of the legs 44*a* and 44*b* and therefore in the height of the table 40**.

Further details of the attaching means 18 of the table of FIG. 1 is shown in FIGS. 6 through 8. The attaching means 18 comprises a bracket 50 preferably a channel member attached to the undersurface of the table top 12 by means of screws 51 extending through holes 49 in the bracket 50. Bracket 50 is preferably provided with a locking lever 52 attached through a pivot point 54 at one end of the bracket 50, locking lever 52 freely pivoting about pivot point 54 while being restrained in its movement toward and away from the bracket 50. A securing means 56 which in the embodiment shown is a pin means, preferably a cotter pin is provided and is preferably attached to the locking lever 52 by means of a chain 58.

In operation, the table 10 is set up by raising the table top 12 and allowing leg **14*b* to enter the channel member 50. The holes provided in the leg 14*b* and the channel member 50 are aligned and the securing means 56 is inserted through the aligned holes of the channel member 50 and the leg 14*b*. In this way, leg 14*b* is securely held by the attaching means 18. In order to reduce the possibility of accidental loosening of the securing means 56 and thereby collapse of the table 10, The locking lever 52 is pivoted into its locked position overlying the head of the securing means 56. A camming surface 60 is provided on the locking lever 52 which allows the locking lever 52 to ride up over the head of the securing means 56 and thereby being urged away from the bracket 50 against the restraint on movement of the locking lever. Immediately below the camming surface 60, a securing means receiving means for releasably securing said securing means in the operating position is provided by depression 62 of a size to catch and harbour the head of the securing means 56 when the locking lever 52 is in the locked position. The co-operation of the securing means 56 and the locking lever 52 when in the locked position as a result of the head of the securing means 56 being held in the depression 62 of the locking lever 52 aids in the maintenance of the locked position. In this way, the securing means 56 is restrained form slipping out of position while it securely holds the leg 14***b* to the attaching means 18 of the table top 12.

The operations involved in the collapse of the table 10 are illustrated in FIGS. 4 and 5. The locking lever 52 is first released from the locked position overlying the securing means 56 by urging the lever 52 away from the attaching means 18 until the head of the securing means 56 is released from engagement with the depression 62 of the locking lever 52 and thereafter the locking lever 52 is allowed to pivot about pivot point 54 to the released position as shown in FIG. 4. The securing means 56 is thereafter removed and the table 10 is brought to its storage position by collapse of the table leg 14*b* as shown in FIG. 5.

It will now be seen how a collapsible table according to the present invention provides for both a secure and stable table when in the operating position as well as allowing ease of set up of the table and ease of collapse for storage.

Although various preferred embodiments of the invention have been described in detail, it will be appreciated by those skilled in the art that variations may be made thereto without departing from the spirit of the invention or the scope of the appended claims.

The embodiments of the invention in which an exclusive property or privilege is claimed are as follows:

1. A collapsible table comprising a table top, and at least a first and a second leg having a scissors action connection to one another, said first leg being pivotally secured at a first location to said table top, said second leg being pivotally and removably secured by attaching means at a second location to said table top spaced from said first location, said second leg having a hole provided therethrough in the portion removably secured by said attaching means;

said attaching means comprising a bracket attached to the table top at said second location, said bracket being provided with at least one hole therethrough, said hole in said second leg and at least one said hole in said bracket aligning when said second leg is placed at said second location in said bracket;

securing pin means for placement in said aligned holes to secure said leg to said bracket, said securing pin means having an enlarged head; and releasable locking means is a locking lever pivotally secured to said bracket having a securing pin means receiving means for releasably securing said securing pin means when said securing pin means is placed in said aligned holes, said securing pin means receiving means being provided by a depression in said locking means of a size to releasably catch and harbor said enlarged head of said securing pin means.

2. A collapsible table as claimed in claim 1 wherein said bracket is provided with a plurality of holes.

3. A collapsible table as claimed in claim 1 wherein said pin means is a cotter pin having an enlarged head.

* * * * *